United States Patent [19]

Johansson et al.

[11] Patent Number: 4,875,555

[45] Date of Patent: Oct. 24, 1989

[54] PATIENT LIFTING DEVICE

[75] Inventors: Jan A. Johansson, Braås; Jan I. Jönsson, Moheda; Björn T. Lindström, Stockholm, all of Sweden

[73] Assignee: Aktiebolaget Electrolux, Stockholm, Sweden

[21] Appl. No.: 126,024

[22] Filed: Nov. 27, 1987

[30] Foreign Application Priority Data

Dec. 29, 1986 [SE] Sweden ..... 8605592

[51] Int. Cl.[4] ..... B66B 9/20; A61G 7/10

[52] U.S. Cl. ..... 187/9 R; 187/24; 187/25; 5/86; 267/75

[58] Field of Search ..... 187/9 R, 24, 25; 5/81 R, 83, 86, 87; 267/75

[56] References Cited

U.S. PATENT DOCUMENTS

| | | | |
|---|---|---|---|
| 1,563,792 | 12/1925 | Rickard | 187/24 |
| 3,309,060 | 3/1967 | Villars | 187/24 X |
| 3,940,808 | 3/1976 | Petrini | 5/86 |
| 4,475,072 | 10/1984 | Schwehr et al. | 269/323 X |
| 4,631,761 | 12/1986 | Lederman | 5/86 X |
| 4,633,538 | 1/1987 | James | 5/86 |
| 4,742,891 | 5/1988 | Kunii et al. | 187/25 |

FOREIGN PATENT DOCUMENTS

| | | |
|---|---|---|
| 96208 | 12/1983 | European Pat. Off. . |
| 198946 | 10/1986 | European Pat. Off. . |

*Primary Examiner*—Joseph J. Rolla
*Assistant Examiner*—Gregory L. Huson
*Attorney, Agent, or Firm*—Pearne, Gordon, McCoy & Granger

[57] ABSTRACT

A patient lifting device shows a lifting platform (26) connected to an upper column part (16), which is raiseable and lowerable by a jack (18) operated by an electric motor (20). A gas spring (34) is arranged between the upper column part (16) and a lower part (24) of the jack (18) to reduce the load on said jack. The lower part (24) rests on a seat (27), from which it can move in upwards direction. If the lifting platform (26) on lowering is stopped by an obstacle (30) the jack (18) will continue to retract, the lower part (24) together with an arm (28) moving upwards from the seat (27), which arm (28) acts on a switch (32) to break the current to the jack (18), which thereby is stopped.

3 Claims, 2 Drawing Sheets

PATIENT LIFTING DEVICE

The invention relates to a patient lifting device comprising a bottom part showing a base and a lower column part, a lifting platform connected to an upper column part which is raiseable and lowerable relative to the lower column part, an electrically driven, rectilinearly extendable jack arranged to raise and lower the upper column part with the lifting platform, the upper part of the jack being anchored to the upper column part and the lower part of the jack being anchored to the bottom part and one of said parts being anchored with an axial play, which allows an axial relative movement at the corresponding anchoring place when the jack continues to retract after the lifting platform on lowering has been stopped by an obstacle, and means utilizing said relative movement to break the current to the jack and thereby stopping it.

Said stopping of the jack is effected in order that the lifting platform shall not continue to move downwards after it has encountered an obstacle, in which case the patient lifting device could tip over and cause an accident.

Such a patient lifting device is known through e.g. the European patent application publication No. 198 946.

The object of the invention is to improve the patient lifting device introductorily set forth by providing it with a gas spring which reduces the load on said electrically driven jack without losing the property of the jack to stop, when the platform on lowering is stopped by an obstacle.

This object is attained by the patient lifting device according to the invention thereby that a so-called gas spring is arranged in parallel with the jack to unload it, one end of the gas spring being fixedly connected to the part of the jack which is anchored with the axial play.

A patient lifting device operated by an electrical jack, which is unloaded by a gas spring, is known per se through the European patent application publication No. 96 208, page 6, line 6. Said publication does not, however, suggest how the gas spring shall be arranged at a patient lifting device of the kind introductorily set forth in order to maintain the property of the jack to stop, when the platform on lowering is stopped by an obstacle.

The reduction of the load on the jack by the gas spring brings with it, a decrease in consumption of electrical energy of the jack having the advantage that, when the jack is driven by a chargeable battery located on the patient lifting device, the battery need not be charged so often.

Figure 1:
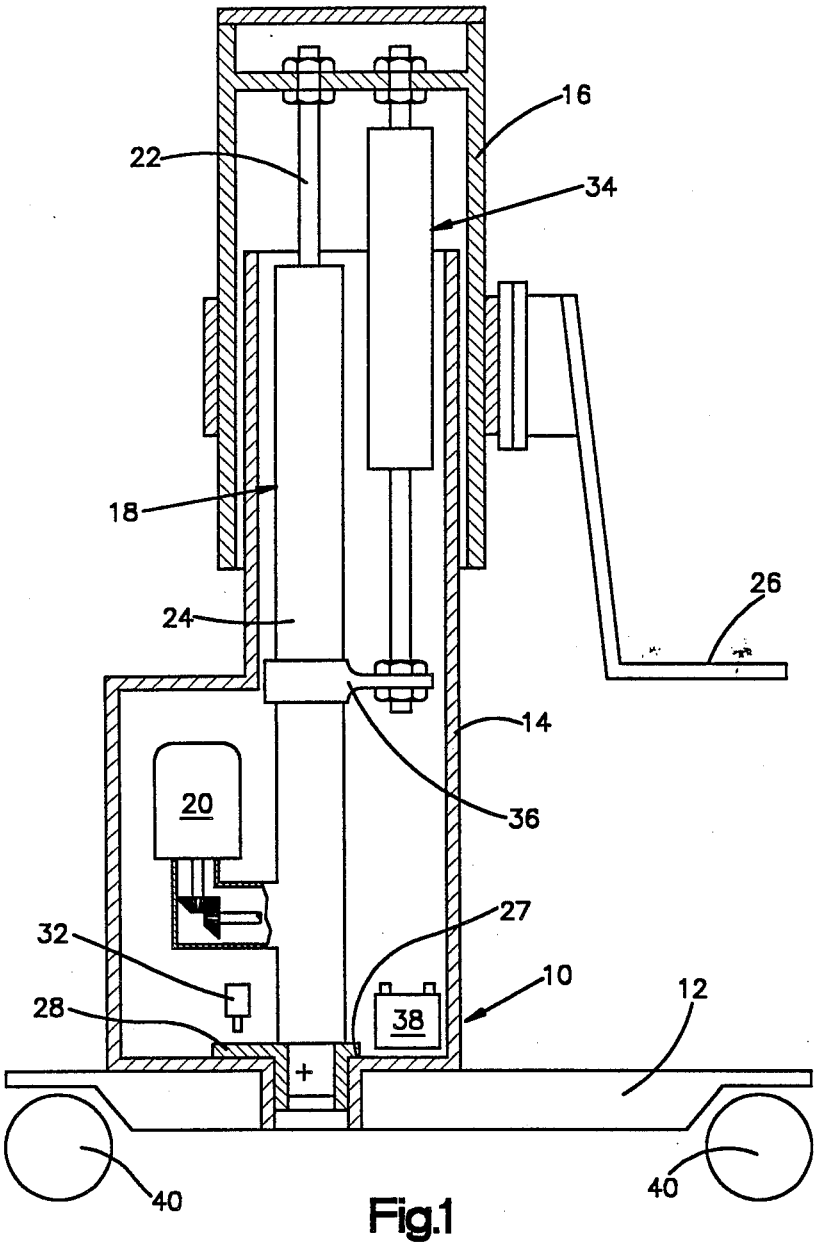
Figure 2:
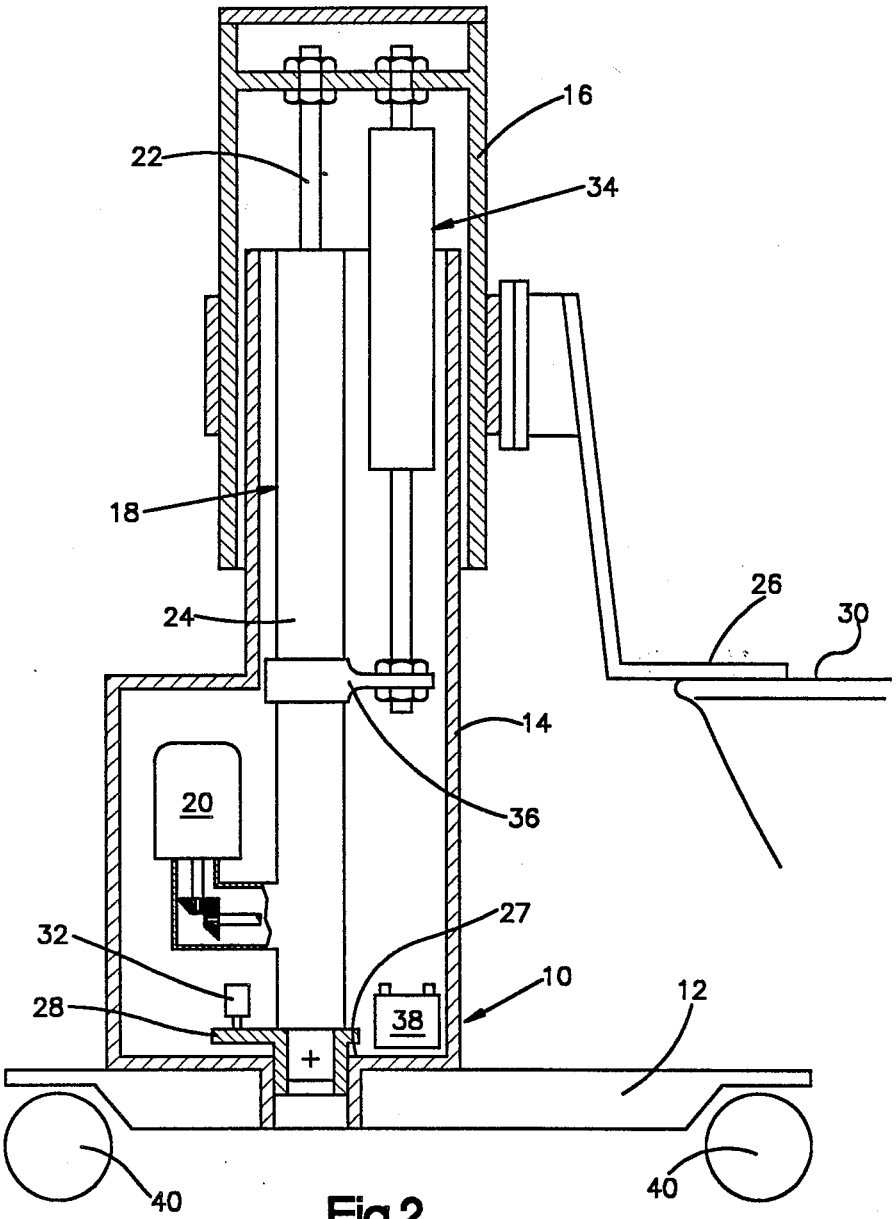

An embodiment of a patient lifting device according to the invention will now be described below in connection with the accompanying drawings, in which FIG. 1 shows a longitudinal sectional view of the patient lifting device and FIG. 2 shows the same lifting device when a lifting platform has been stopped by an obstacle.

The numeral 10 designates a bottom part showing a base 12 and a lower column part 14, on which an upper column part 16 is displaceably journalled. The upper column part 16 is raiseable and lowerable by a jack 18 which is driveable by an electric motor 20, driving a longitudinal screw in the jack 18. The screw engages a nut connected to a rod 22 of the jack, so that the rod 22 is displaced in its longitudinal direction relative to a lower part 24 of the jack when the screw rotates. A lifting platform 26 for a patient is fixedly connected to the upper column part 16.

The rod 22 is fixedly connected to the upper column part 16. The lower part 24 of the jack is arranged to support against a seat 27 of the bottom part 10, from which seat the lower part 24 can move in upwards direction. A plate 28 is fixedly connected to the lower pat 24. If the lifting platform 26 during lowering movement is stopped by an obstacle, e.g. a bath tub 30, the jack 18 will continue to retract causing the lower part 24 with the arm 28 to move upwards from the seat 27 until the arm 28 acts on a switch 32, which breaks the electric current to the motor 20 and thus stops the jack.

The load on jack 18 is reduced by a gas spring 34, the one end of which being fixedly connected to the upper column part 16 and the other end of which being fixedly connected to the lower part 24 of the jack via an arm 36. The gas spring 34, the force of which being substantially constant during the whole stroke of the gas spring as is characteristic for gas springs, is arranged to lift the upper column part 16 with a force substantially equal to the weight of the parts of the patient lifting device moving in vertical direction together with the upper column part 16 plus 37.5 kiloponds in which one kilopond is the gravity force on one kilogram (i.e. 9.80665 Newtons.), which is half the weight of an average patient. By this the jack 18 will be loaded by an up force of substantially 37.5 kiloponds when the platform 26 is unloaded and by a down force of substantially 37.5 kiloponds, when the platform is loaded by a patient with a weight of 75 kilogrammes.

The electric motor 20 is driven by a chargeable battery 38. The base 12 is provided with wheels 40, so that the patient lifting device is movable along a floor.

We claim:

1. A patient lifting device comprising a lower part having a base and a lower column portion, an upper part having an upper column portion, a lifting platform, means connecting said platform to said upper column portion whereby said platform is elevated and lowered relative to said lower column portion, an electrically driven and rectilinearly extendable jack having a top part and a bottom part, said jack being mounted between said column portions to selectively raise and lower said upper column portion with said platform, one part of said jack being fixed to one of said column portions, the other part of said jack being anchored with limited axial play to the other said column portion thereby permitting an axial relative movement of said jack at said anchoring place when the jack continues to retract after the platform upon lowering has been stopped by an obstacle, means utilizing said relative movement to interrupt electrical current to said jack thereby stopping it, and a gas spring arranged in parallel to work in tandem with said jack to reduce the working load on said jack by pre-loading the jack, with one end of said gas spring being fixed to said part of said jack which is anchored with limited axial play and the other end of said gas spring being fixed relative to the other part of said jack.

2. A patient lifting device as claimed in claim 1 wherein said bottom part of said jack is anchored to said lower part.

3. A patient lifting device as claimed in claim 1 wherein said means for interrupting electrical current to said jack is a switch located in the path of relative movement of said jack.

* * * * *